United States Patent [19]

Pederson et al.

[11] Patent Number: 4,845,800

[45] Date of Patent: Jul. 11, 1989

[54] FOLDING MOP

[76] Inventors: Darrell L. Pederson, P.O. Box 942; Jerome P. Hall, 934 Jefferson Ave., both of Livermore, Calif. 94550; Donald Mickelson, Rte. 3, Box 42, Elbow Lake, Minn. 56531

[21] Appl. No.: 206,668

[22] Filed: Jun. 15, 1988

[51] Int. Cl.[4] ..... A47L 13/258

[52] U.S. Cl. ..... 15/228; 15/147 R; 15/229.7

[58] Field of Search ..... 15/147 R, 147 A, 147 B, 15/148, 149, 228, 229.1, 229.2, 229.3, 229.4, 229.6, 229.7, 229.8

[56] References Cited

U.S. PATENT DOCUMENTS

| | | | |
|---|---|---|---|
| 1,989,825 | 2/1935 | Schaefer et al. | 306/3 |
| 2,192,861 | 3/1940 | Burchell | 15/147 |
| 2,254,648 | 9/1941 | Gilsdorf | 15/147 |
| 2,325,598 | 8/1943 | Fatland | 15/147 |
| 2,724,851 | 11/1955 | Steiner | 15/147 |
| 2,756,453 | 7/1956 | Mattson | 15/229 |
| 2,840,840 | 7/1958 | Yamen | 15/147 |
| 2,860,360 | 11/1958 | Leavelle | 15/221 |
| 2,921,327 | 1/1960 | Kuehl | 15/147 |
| 3,050,762 | 8/1962 | Ballinger | 15/147 |
| 3,405,418 | 10/1968 | Carter et al. | 15/147 |

FOREIGN PATENT DOCUMENTS

| | | | |
|---|---|---|---|
| 3458886 | 8/1969 | France | 15/147 |
| 3911521 | 10/1975 | France | 15/229 B |

*Primary Examiner*—Edward L. Roberts
*Attorney, Agent, or Firm*—Francis H. Lewis

[57] ABSTRACT

A mop has an elongated mop head fabricated in sections, with each section being connected by a hinge to the adjoining sections on either side. The outermost sections can be rotated upward independently about their respective hinges so that they lie flat and inverted on the adjacent inner sections, forming a mop with a narrower mop head. The two outer sections thus folded on either side can again be rotated upward about the next hinge to lie flat and inverted on the adjoining inner section, with the outer section nested between the other sections in this folded position. By thus folding the various sections the mop head can be adjusted to a variety of lengths. A locking mechanism at each hinge causes each pair of sections to lock in either the extended or folded positions. The mop handle is attached to the center mop head section by means of a universal-type joint. A removable swab is further provided for the mop head.

6 Claims, 4 Drawing Sheets

FOLDING MOP

BACKGROUND OF THE INVENTION

This invention pertains generally to the field of mops and related floor cleaning devices, and more particularly, to mops having an adjustable mop head or frame, so that the size of the mop head may be varied by the mop user to efficiently clean stairs and floors of various configurations having furniture and other obstacles.

Previous mops have been designed with mop heads that are adjustable or collapsible for a variety of different reasons. Some mops have collapsible mop head frames to facilitate removal and replacement of the mop head fabric or swab. Such mops are disclosed, for example, in U.S. Pat. No. 2,192,861 (Burchell), U.S. Pat. No. 2,840,840 (Yamen), and U.S. Pat. No. 3,458,886 (Goettel). These mops have mop head frames that can be folded downward so that the frame is easily removable from pockets in the mop head swab. Other mops are provided with mop head frames of variable length, so that the fabric of the mop head swab can be held taut while the mop is in use and the head can be adjusted to compensate for shrinkage of the fabric after the swab has been washed. Examples of these mops are described in U.S. Pat. No. 2,325,598 (Fatland), U.S. Pat. No. 2,921,327 (Kuehl), and U.S. Pat. No. 3,405,418 (Carter et al.).

The present invention is directed toward mops that are useful for cleaning floor areas of various sizes and shapes, such as stairs, narrow hallways, areas around corners and posts, under chairs and furniture, and large clear areas such as showroom floors, wide corridors, gymnasiums, and the like. Obviously mops having a variable width are useful for these purposes. Such mops have been disclosed in U.S. Pat. No. 2,254,648 (Gilsdorf), U.S. Pat. No. 2,756,453 (Mattson), and U.S. Pat. No. 3,911,521 (Franchot). These mops all have heads of widths that are variable over a very limited range, specifically so that the floor area engaged in a single pass of the mop can be adjusted. This feature is particularly desirable when one is cleaning around and under furniture.

Another mop having a variable mop head width is described in U.S. Pat. No. 2,860,360 (Leavelle). The purpose of the width adjustment in this case is to enable the sweepings to be easily picked up at the end of a pass of the mop by closing the arms of the mop head and trapping the debris in an attached hood. Clearly this objective is different from the purpose of the adjustable-width mops referred to above.

Other mops have been designed with oblong mop heads and handles that can pivot about different axes, so that the effective width of the mop head can be adjusted by rotating the mop about a vertical axis. Examples are disclosed in U.S. Pat. No. 1,989,825 (Schaefer et al.), U.S. Pat. No. 2,724,851 (Steiner), and the Fatland disclosure mentioned above. In fact, mops having a universal-type joint between the handle and mop head are generally known to be useful for cleaning corners, around furniture and obstacles, and other areas that are difficult of access. Such a mop is described in U.S. Pat. No. 3,050,762 (Ballinger).

From the foregoing disclosures it is clear that the problem of designing mops that are useful in confined areas or floors with obstacles has been addressed by others. The solutions have been limited in success. The concept of a universal-type joint between the mop head and the handle has been used to improve the maneuverability of mops with oblong heads, but it doesn't solve the problems arising from the shape or size of the mop head itself. Some of the above mops with heads of adjustable width become deeper in the fore-aft dimension when the width is decreased. This impairs the maneuverability of these mops in many situations. In all cases, the range of head widths is limited and their usefulness is impaired for cleaning large clear floor areas.

SUMMARY OF THE INVENTION

The present invention provides a mop having a mop head frame that is constructed in a plurality of sections connected by hinges, so that the sections may be folded to adjust the width of the mop head over a wide range. The mop handle is pivotally attached to the central mop head frame section. The mop width is maximized by completely unfolding the sections on each side of the central section so that they extend laterally outward from this central section. The mop head width may be decreased by upwardly folding the outermost section on either side, so that the outer section becomes inverted and lays flat on top of the adjacent inward section. The mop head width may be further decreased by upwardly folding the outermost two folded sections in a similar manner, so that they rest on top of the inwardly disposed adjacent section. Each side of the mop may be adjusted independently.

Each hinge is provided with a spring lock, so that each section may be locked in either its folded or extended position, while allowing the mop user to fold or open each section and to adjust the width of the mop head with her or his foot. The mop head swab fits removably over the frame with sufficient flexibility and looseness to allow these sections to be folded in the above manner. The mop handle is detachably connected to the central section of the mop head frame by means of a universal-type joint. This allows the handle to rotate about the joint in both the fore-aft and lateral directions, and thus assume any orientation relative to the mop head.

It is an object of this invention to provide a mop having a mop head width that is easily adjustable over a large range, so that the mop may be efficiently used on floors or stairs having a wide variety of obstacles, such as furniture or the like, and also on corners, narrow hallways, and other floor surfaces that are difficult of access, and so that the mop may also be easily used on floors having large clear areas.

A second object of the invention is to provide a floor mop that may be used with the mop handle in any orientation relative to the mop head, so that the mop can be easily used in areas of floor that are confined or that have obstacles that would otherwise restrict the position of the mop handle, such as narrow hallways and doorways, for example.

A further object of the invention is to provide a floor mop having a mop head swab that can be easily attached to or detached from the support frame for purposes of cleaning and replacement.

These and other objects, advantages, characteristics and features of the invention may be better understood by examining the following drawings together with the detailed description of the preferred embodiment.

DETAILED DESCRIPTION OF THE PREFERRED EMBODIMENT

Figure 2:
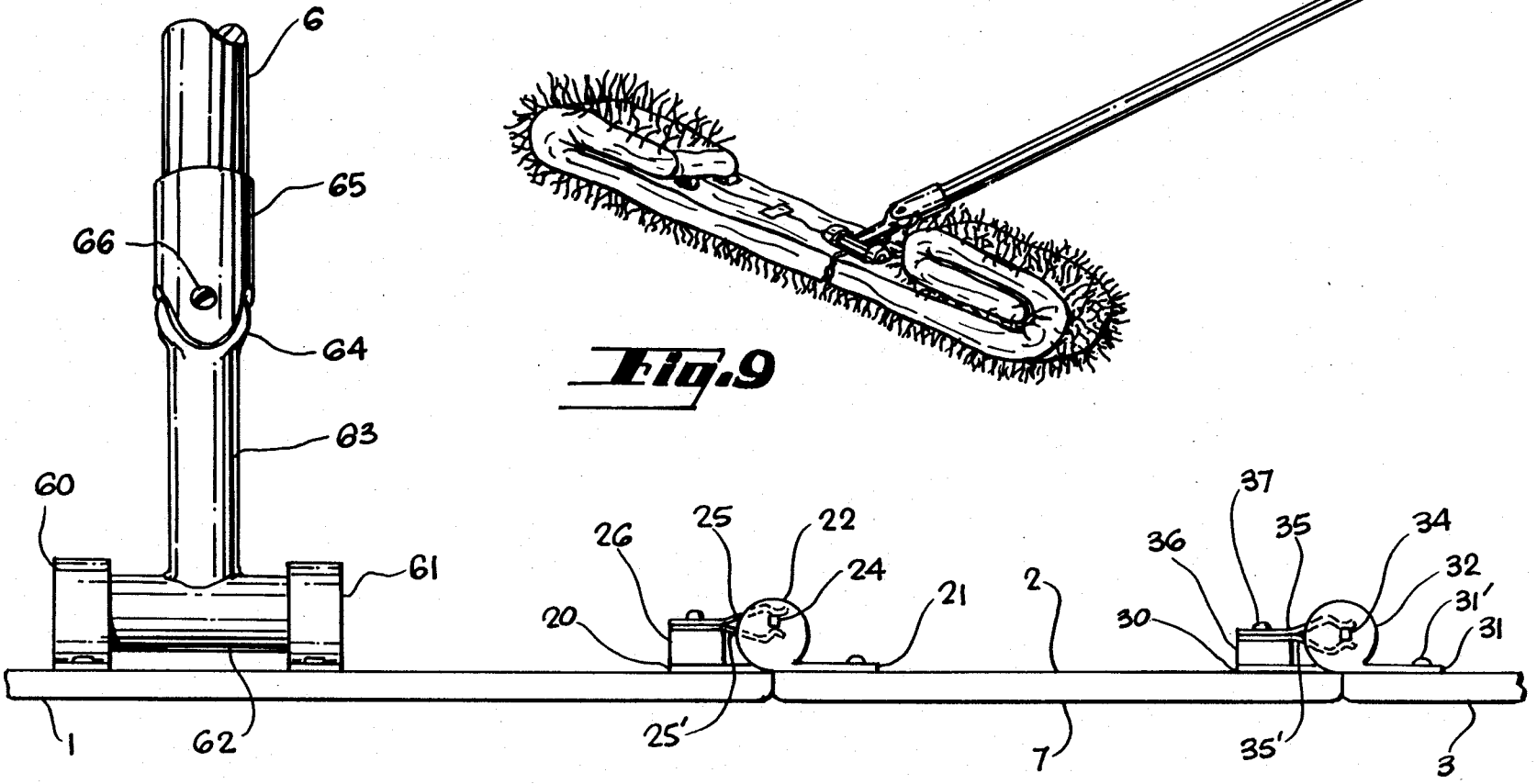
FIG. 2 is a broken elevational view of the right-hand portion of the mop shown in FIG. 1, illustrating the joint connecting the central mop section to the mop handle and the hinge joints connecting the right mop sections.
Figure 3:
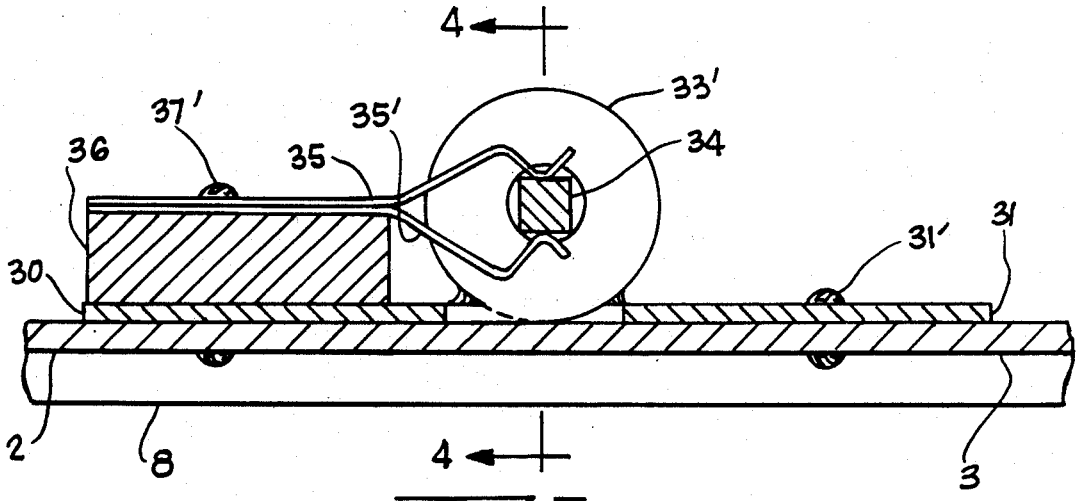
FIG. 3 is a horizontal broken sectional view of the mop taken along the lines 3—3 in FIG. 1, showing the structure of the hinge connecting the two sections to the right of the central section.
Figure 4:
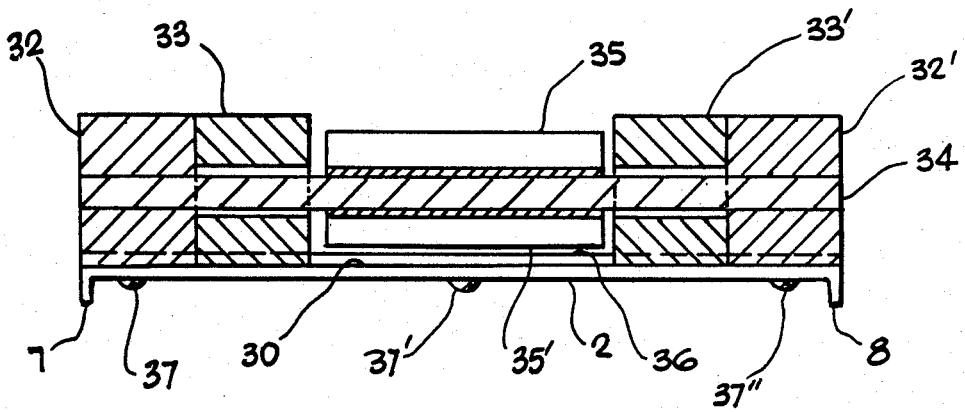
FIG. 4 is a horizontal sectional view of the mop taken along the lines 4—4 in FIG. 1, further displaying the structure of the hinge connecting the two sections to the right of the central section.

Referring to FIGS. 1, 2, 3, and 4, the mop according to the present invention has a mop head comprised of a sequence of linearly disposed sections, each section being connected by a hinge to each adjacent section. The embodiment described here has a central mop head section 1 attached to the mop handle 6, and two sections on either side of the center section, and the mop head is symmetrical in structure on each side of the mop handle. Immediately to the right of the central section 1 is the middle section 2, and the outer section 3 is disposed immediately to the right of section 2. Corresponding mop head sections 4 and 5 are disposed to the left of the central section 1. FIGS. 1 through 4 all show the mop head support frame with the fabric swab removed. FIG. 4 shows that section 2 is fabricated from a flat plate bed with short downwardly-extending lips 7, 8, along the front and rear edges of the bed, forming a shallow "inverted-U" shape. The other sections are fabricated in the same manner, and when the mop head is fully extended as in FIG. 1, the edges of the beds and lips of adjoining sections abut each other so that the surfaces of the beds and the lips lie in respectively common planes along the entire length of the mop head.

The hinge connecting sections 2 and 3 has a hinge plate 30 along the right-hand upper edge of section 2 and a corresponding hinge plate 31 along the left-hand upper edge of section 3. Plate 31 typically may be fastened to the bed of section 3 by rivets 31', 31''. Short cylindrical pin supports 32, 32', are integrally attached, by welding for example, to the left-hand sides of the hinge plate 31, along the front and rear edges respectively, so that they extend upward with the axes of the respective cylinders collinear with each other and lying in the vertical plane defined by the abutting edges of sections 2 and 3. Similar short cylindrical pin cylinders 33, 33', are integrally attached to the right-hand sides of the hinge plate 30, extending upward and disposed immediately inwardly adjacent to the pin supports 32, 32', so that the cylindrical axes of all of the supports and cylinders are collinear. The pin cylinders 33, 33' each have a hole penetrating them entirely along this common axis, and a hinge pin 34 extends through these holes along this axis and is integrally attached to the pin supports 32, 32' at each end. The pin cylinders 33, 33', are not fastened to this hinge pin 34, but are capable of rotating around it, and therefore the hinge plates 30, 31, can rotate relative to each other about this hinge pin axis.

Figure 1:
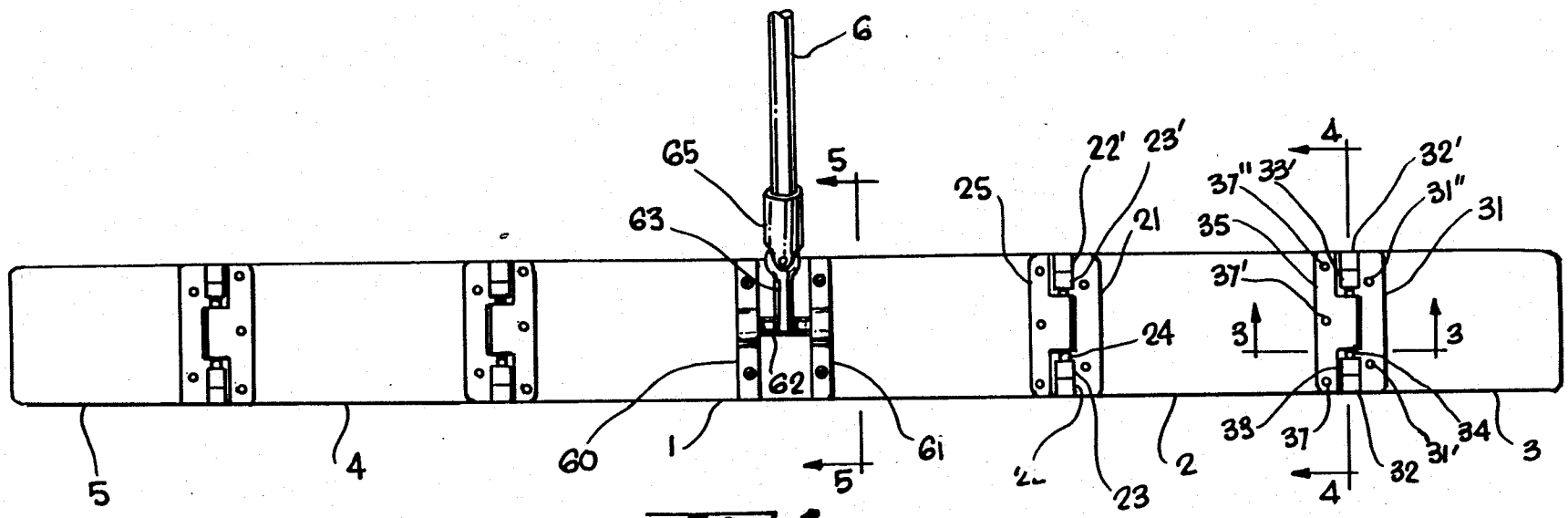
FIG. 1 is the top view of a mop according to the present invention with the mop head swab removed to display the hinged sections of the mop head support frame when it is adjusted to its full extension or maximum width.

Referring still to FIGS. 1 through 4, the hinge pin 34 has a square cross sectin along its entire length. Two adjacent plates 35, 35', each fabricated from spring steel, extend horizontally into the region between the cylinders 33, 33' along the hinge pin, with plate 35 projecting over thhis hinge pin and plate 35' projecting under said pin. These plates are supported by shim 36 lying on the hinge plate 30, the entire structure is fastened to the bed of section 2 by rivets 37, 37', 37'' extending through the plates, shim and bed, or by any similar means. The shim 36 has a thickness such that the interface between the plates 35, 35' is at approximately the same elevation as the axis of the hinge pin 34. The two plates are each bent in the unsupported regions to form a rounded edge that is in contact with one face of the hinge pin along its length, with the contact points of the two plates being on opposite sides of the hinge pin. Further, the plates are bent such that when fastened in this manner, these rounded edges are urged against the flat faces of the hinge pin 34, gripping the pin on opposite sides, as indicated in FIGS. 3 and 4. It is preferable to provide a slight groove in each face of the hinge pin 34 along the center line at the point where the rounded edges of the plates make contact with these faces, to facilitate this gripping action.

From the above description it will be seen that the spring plate gripping pressure has the effect of resisting any angular displacement of the hinge plates from the extended position shown in FIGS. 1-3. As soon as section 3 begins to rotate upward, the corners of the pin 34 push the plates 35, 35', away from the pin axis by a cam action against the spring resistance. Thus the hinge plates, and sections 2 and 3, are "locked" in the extended position. However, if the right end of section 3 is lifted with sufficient force to reach an angle of 90°, the spring plates again press against the flat portions of the hinge pin surface, causing sections 2 and 3 to become "locked" in this new position. Further counter-clockwise rotation of section 3 will cause the to sections to lock at an angle of 180° when section 3 has become inverted and is lying on top of section 2, which is the completely folded position for these two sections.

Referring still to FIGS. 1 and 2, the hinge structure between the central mop head section 1 and the middle section 2 is identical to the hinge between sections 2 and 3 described above, with two exceptions. It will be noted from FIG. 2 that the hinge pin 24 is located eccentrically in the pin supports 22, 22' and pin cylinders 23, 23', and that it is at a higher elevation than the hinge pin 34 in the hinge between sections 2 and 3. The shim 26 that supports the spring plates 25, 25', is therefore thicker than the corresponding shim 36 by the difference between the hinge pin elevations, so that the spring plate pressure on the hinge pin is the same for both hinges.

Figure 6:
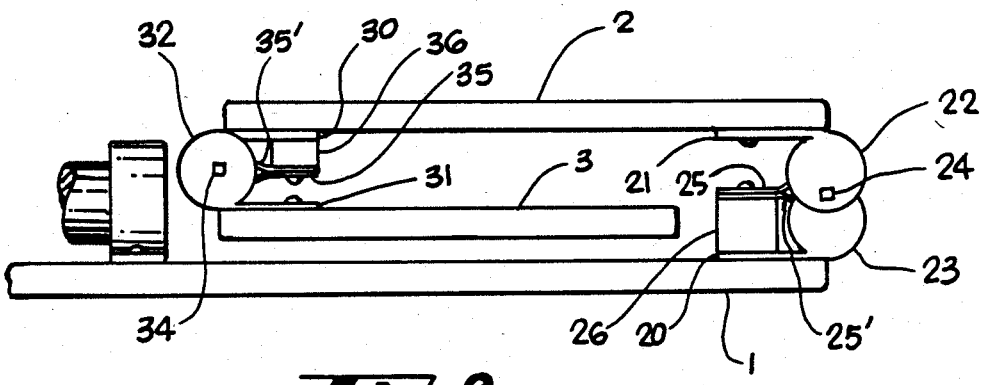
FIG. 6 is a horizontal broken view of the mop head sections on the right side of the mop of FIG. 1 when they are folded completely so that the right portion of the mop head is adjusted to its minimum width.

The purpose of the above-described structural difference between the two hinges will be seen by referring to FIG. 6. When the central section 1 and middle section 2 are folded completely, the eccentric location of the hinge pin 24 causes the bed of section 2 to be raised substantially above the bed of section 1 to provide sufficient space between them for the folded section 3. In the folded configuration, then, all three sections are in parallel alignment. Although the figures are not drawn to scale, it will also be readily apparent from FIG. 6 that section 3 must be shorter in length than section 2, and that section 1 must be more than twice as long as section 2, in order to allow space for the hinge structures and handle joint when the mop is folded. The additional space between the sections shown in FIG. 6 is occupied by the mop head swab that covers the frame and is omitted from these figures.

Figure 5:
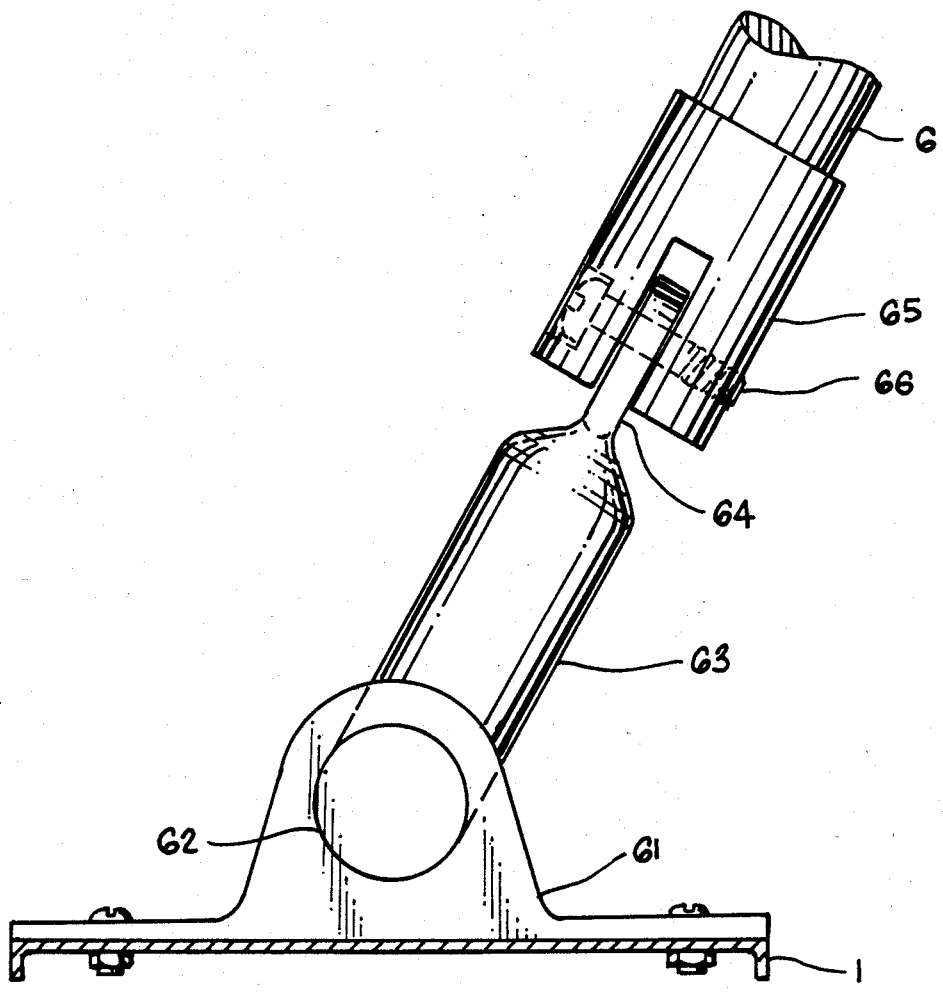
FIG. 5 is a sectional view of the mop taken along the lines 5—5 in FIG. 1, showing the structure of the universal-type joint connecting the mop handle to the central mop section.

Referring now to FIGS. 1, 2, and 5, the mop handle is joined to the central section of the mop head by a universal-type joint. Two parallel brackets, 60, 61, are attached to the bed of the central section 1 symmetrically spaced to the left and right about the center of this section. Mutually parallel ears on these brackets extend upward and are provided with holes to support the horizontal shaft 62 that extends between them along the longitudinal axis of the mop head. This shaft 62 is capable of rotation within the holes in these bracket ears, which therefore comprise a journal housing for the shaft. One end of a second shaft 63 is integrally attached, by welding or similar means, to the center of the horizontal shaft 62, and this second shaft 63 extends in a generally upward direction perpendicular to the horizontal shaft 62. The other end of this shaft 63 is provided with a flat tongue 64 that is parallel to the horizontal shaft 62 and the longitudinal axis of the mop head. This tongue fits between the forked ends of a fitting 65 that is attached to the lower end of the mop handle 6. The flat tongue 64 and the forked ends of the fitting 65 are provided with aligned holes which accommodate a bolt 66 or other threaded fastener by which the tongue 64 is attached to the fitting 65. The hole in the tongue 64 is sufficiently large to allow the fitting 65 to rotate about the axis of the bolt 66. The head of the bolt is prefereably recessed into the fitting, as indicated in FIG. 5.

It is apparent that the structure described above permits the mop handle to rotate independently about two mutually perpendicular axes, namely that of the shaft 62 and the bolt 66, both of which are perpendicular to the handle itself. Therefore the handle can assume any upwardly disposed orientation relative to the central section of the mop head. In addition, the use of a threaded fastener 66 in the fitting 65 allows one to easily detach and replace the mop handle 6.

The hinge structures connecting the mop head sections 4 and 5 to the central section 1 are identical to the corresponding hinge structures connecting sections 2 and 3 to section 1. Thus the mop head sections on the left side of the mop can be folded in exactly the same manner as the sections on the right side.

Figure 7:
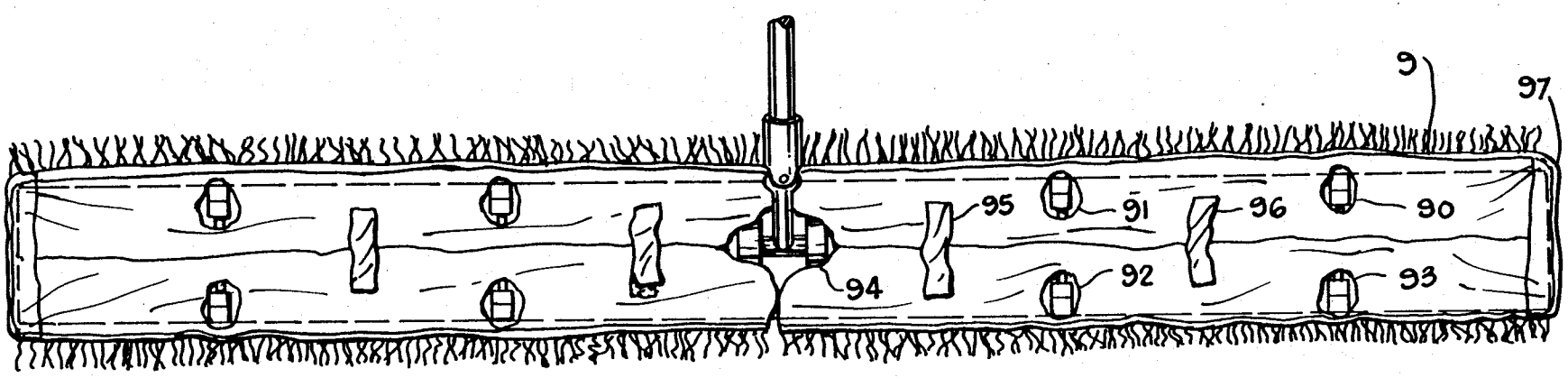
FIG. 7 is a top view of the mop according to the present invention, similar to FIG. 1 but with the mop head swab in place over the mob head support frame.
Figure 8:
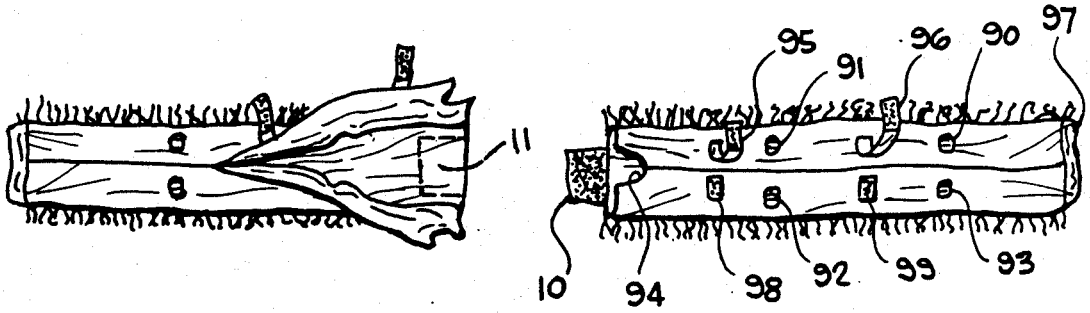
FIG. 8 is a top view of the two halves of the mop head swab of FIG. 8, removed from the support frame and detached from each other, showing the Velcro fabric strips by which the swab is attached to the mop head frame.

Referring now to FIG. 7, the entire mop head frame is covered with the fabric swab 9, that is fabricated from two separate sleeves fitting respectively over the right and left sides of the mop head frame and symmetrically disposed about the center of the frame. These sleeves are also shown in FIG. 8, separated from the mop head frame and from each other to clarify the details of their structure.

Considering first the sleeve over the right portion of the mop head frame, the fabric on the top is slit lengthwise down the center of the sleeve to allow the right end of the mop head to be inserted in the sleeve. The remote end of the sleeve is bound with padded reinforcement 97 to protect the mop and any furniture from damage by bumping or scraping against this end of the mop head. The top fabric is also provided with cutout holes 95, 96, 98, 99, which fit over and around the pin supports and cylinders of the hinges when the sleeve is installed on the mop head frame. An additional cutout portion 94 is provided at the top fabric surface on the left end of the sleeve. When both sleeves are in place on the mop head frame, the joint connecting the mop handle to the frame projects upward through the hole formed by this cutout portion and the corresponding cutout on the left sleeve. One end of each of the fabric strips 95, 96, is stitched or otherwise fastened to one side of the top surface of the sleeve. Velcro patches are sewn on the underside of these strips at the other end, and corresponding mating Velcro patches 98, 99, are sewn on the opposite side of the top sleeve surface, so that the longitudinal slit can be closed by pulling the strips across it and attaching them to the corresponding Velcro patches. Finally, the left end of the lower surface of the swab is provided with a fabric tab 10 having a Velcro surface on top, and the underside of the right end of the other sleeve has a corresponding patch of Velcro material 11 (at the location indicated by the dotted lines in FIG. 8). When they are installed on the mop head frames, the sleeves are attached to each other by pressing the tab 10 against the corresponding patch 11 on the lower surfaces.

The sleeve over the left side of the mop head is the mirror image of the sleeve over the right portion, and has structures corresponding exactly to those labelled 90 through 99, described above. Sleeves constructed in this way are easily removable from the mop head frame for washing or cleaning, and can be reinstalled quickly and easily. The cutout portions in the upper surfaces of the sleeves facilitate the folding of the mop head sections because the material around the hinge structures tends to bunch and gather when the sections are folded. Typically the mop head swab may be made from canvas, although other fabrics are suitable. Although Velcro patches are used in the embodiment described here for fabric fastening, other means could be substituted, such as zippers, snaps, buttons, tie-strings, and the like.

Figure 9:
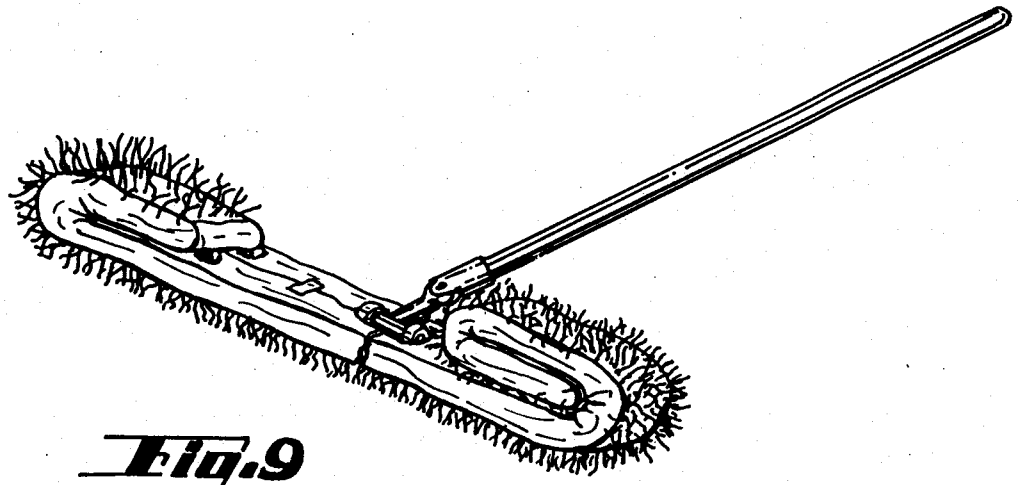
FIG. 9 is a perspective view of the mop according to the present invention, with the sections on the left side of the mop head (as viewed in the drawing) partially folded, and the sections on the right side of the mop head completely folded.

Finally, FIG. 9 indicates one particular mode of operation of the mop according to this invention. In this figure the left side of the mop is folded once and the right side is completely folded, producing a mop that is asymmetrical. The different sections can be folded and unfolded by using one's foot while holding the mop, so that a variety of mop head widths can be attained. This large range of attainable mop head widths is a principal feature of the present invention. For example, if the center section is approximately 2½ feet wide, the middle sections are approximately 1 foot wide, and the outer sections are approximately 9 inches wide, then the overall mop head width can be adjusted from approximately 2½ feet to 6 feet. It is believed that this range of variation has not been heretofore realized in previous mops.

The foregoing description refers to a support frame having 5 sections, namely a central section and two sections on each side of the mop handle. Clearly the invention is not limited to a specific number of frame sections, or any particular mop frame dimensions, and additional frame sections could be provided in a manner that is unambiguous from the foregoing description. This disclosure is presented solely for purposes of illustration and description. It is not intended to be exhaustive or to limit the invention to the precise form disclosed, and obviously many modifications and variations are possible in the light of the above teaching. The embodiment is chosen and described in order to best explain the principles of the invention and its practical applications to thereby enable others skilled in the art to best utilize the invention in various embodiments and with various modifications as are suitable to the particular use contemplated. It is intended that the spirit and scope of the invention are to be defined by reference to the claims appended hereto.

What is claimed is:

1. A mop, comprising:

an elongated mop head having a plurality of sections disposed along the length of the head, one of such sections being disposed at the center of the mop head;

hinge means connecting each section to the adjacent sections of the mop head, such that said hinge means enables each pair of adjacent sections to rotate relative to each other about a horizontal axis that is perpendicular to the axis of the mop, and such that the outer section of such pair may be rotated upward about said hinge axis to an inverted folded position over the inner section of such pair, whereby the mop head may be folded by folding first the outer sections on to the adjacent inner sections, and then successively folding the already folded sections on to the adjacent inner unfolded sections; and a mop handle, one end of which is pivotally connected to said center section of said mop head.

2. A mop as recited in claim 1, wherein said mop handle is connected to said center section such that said handle may rotate independently about two mutually perpendicular axes, each axis being perpendicular to said handle.

3. A mop as recited in claim 1, wherein said hinge means further includes locking means such that each pair of adjacent sections is constrained by said locking means when said sections are in relatively extended orientation, and when said sections are in relatively folded orientation.

4. A mop as recited in claim 3, wherein said mop handle is connected to said center section such that said handle may rotate independently about two mutually perpendicular axes, each axis being perpendicular to said handle.

5. A mop as recited in claim 3, wherein said hinge means between each pair of adjacent sections comprises:

two hinge plate members, each of said members being attached to the end portion of one of said sections, each of said members further having a projecting structure extending upward over the interface between said sections;

a hinge pin rigidly attached to the projecting structure of one of said hinge plate members and passing through a hole in the projecting structure of the other hinge plate member and rotatably engaging said member, said hinge pin being upwardly disposed over, and parallel to, the interface between said sections, the axis of said hinge pin being the hinge axis of relative rotation between said sections, said hinge pin further having a cross section perpendicular to its axis that is non-circular; and a spring member attached to said hinge plate member having a hole through which said hinge pin passes, said spring member further contacting the lateral surface of said hinge pin in pressing engagement along the portion having a non-circular cross section, such that said spring member urges said hinge plate members to stably remain in any one of a plurality of relative angular orientations.

6. A mop as recited in claim 5, wherein said mop handle is connected to said center section such that said handle may rotate independently about two mutually perpendicular axes, each axis being perpendicular to said handle.

* * * * *